United States Patent [19]

Lyatkher et al.

[11] 4,079,890

[45] Mar. 21, 1978

[54] DEVICE FOR BUILDING UP HIGH PULSE LIQUID PRESSURES

[76] Inventors: Viktor Mikhailovich Lyatkher, ulitsa Shturvalnaya, 5, korpus 1. kv. 129, Moscow; Valentin Pavlovich Nikolaev, ulitsa Borodinskaya, 6, kv. 30, Zaporozhie; Alexandr Nikolaevich Militeev, 4 Sokolnicheskaya ulitsa, 4, kv. 2; Sergei Yakovlevich Shkolnikov, ulitsa Solyanka 1/2, kv. 46, both of Moscow, all of U.S.S.R.

[21] Appl. No.: 754,436

[22] Filed: Dec. 27, 1976

[51] Int. Cl.[2] ..... E21B 7/18

[52] U.S. Cl. ..... 239/101; 239/601; 175/67

[58] Field of Search ..... 239/101, 102, 601, 602; 299/17; 175/67, 422

[56] References Cited

U.S. PATENT DOCUMENTS

| | | | |
|---|---|---|---|
| B 380,014 | 1/1975 | Glenn et al. | 239/602 X |
| 3,343,794 | 9/1967 | Voitsekhovsky | 239/101 |
| 3,601,987 | 8/1971 | Chermensky et al. | 299/17 X |
| 3,748,953 | 7/1973 | Godfrey | 239/101 X |
| 3,796,371 | 3/1974 | Taylor et al. | 239/101 |

*Primary Examiner*—Robert W. Saifer

*Attorney, Agent, or Firm*—Lackenbach, Lilling & Siegel

[57] ABSTRACT

A device intended for building up high pulse liquid pressures may find suitable application in the mining industry and can be advantageously used in constructions of hydro-power installations. The device comprises a cylinder accommodating a two-step piston having an accelerating actuator. The piston step of smaller diameter is positioned, during the piston stroke, within a high-pressure chamber communicating with a liquid supply source and fitted with an opening for the liquid discharge. The piston step of smaller diameter is provided with a rod having a widening at the free end thereof, while the high-pressure chamber has a constricted portion passing into a widening towards the opening for the liquid discharge. At the initial stage of the piston stroke, the widening of the rod overlaps the constricted portion of the chamber to lock the liquid within the chamber between the constricted portion thereof and the piston step of smaller diameter, whereby high pressure of the particular liquid is built up. As the piston continuous to move in the space between the rod and the widenings of the high-pressure chamber, a channel with an annular cross-section is formed. This channel serves to communicate the high-pressure chamber with the opening for the liquid discharge. The proposed device makes it possible to substantially increase the jet force of the discharged liquid and enhance the factor of utilization of energy derived from the piston acceleration.

2 Claims, 3 Drawing Figures

DEVICE FOR BUILDING UP HIGH PULSE LIQUID PRESSURES

The present invention relates to devices for building up fluid pressures, and more particularly to a device for building up high pulse liquid pressures.

The invention may find suitable application in the mining industry and can be advantageously used in the construction of hydro-power installations, and in road building for the destruction of hard solid rock without employing explosives, for example, in tunnelling.

The device for building up high pulse liquid pressures is likewise fit for the destruction of ices, for the treatment of metallic surfaces and those of construction structures, and for the destruction of used furnace refractory linings and obsolete concrete foundations.

Known in the prior art are devices for building up high pulse liquid pressures, which comprise at least one cylinder accommodating a stepped piston therein. On one side of the piston, the cylinder space is filled with compressed gas and communicates with a receiver through an opening in the cylinder. The space on the other side of the piston is filled with a liquid whose pressure urges the piston to travel towards the space filled with gas. The space to be filled with liquid passes in a stepped manner into the space with smaller diameter substantially equal to that of the piston step facing this space. The space with smaller diameter, serves as a high-pressure chamber and is also filled with liquid as the piston moves towards the space filled with gas, and it is fitted with at least one outlet opening provided with a means for periodical locking thereof. High pressure in the chamber is built up as a result of an impact of the piston upon the liquid in this chamber, said piston obtaining mechanical energy in the process of its acceleration during expansion of compressed gas.

In the prior-art device, the outlet opening of the high-pressure chamber is opened in the process of the piston acceleration prior to building up of the pressure required for the impact. Thus, the opening in the high-pressure chamber remains exposed with the pressure therein either rising or falling.

The main disadvantage of the hereinabove described prior-art device lies in that high pressure is built up in the high-pressure chamber with the outlet opening thereof being exposed. This results in the accelerated velocity of the liquid jet coming out of the high-pressure chamber due to higher pressure being built up therein. Each preceding part of the outflowing jet has a velocity lower as compared to that of the successive part of the outflowing jet. Therefore, the preceding low-velocity jets are destroyed by the successive jets of higher velocity, which leads to jet spraying and losses of the initial kinetic energy of piston in an amount from 30 to 50 percent.

Another disadvantage of the device known in the art is in that the maximum liquid pressure in the high-pressure chamber is maintained for a short length of the piston stroke relative to the high-pressure chamber. Therefore, the strength of the high-pressure chamber, designed to withstand maximum pressure is not fully used particularly within the greater length of the piston stroke. This results in the decrease of the permissible amount of the energy required for the liquid discharge.

The primary object of the invention is to provide a device for building up high pulse liquid pressures, wherein the piston and the high-pressure chamber would feature such a constructional arrangement that would provide for maximum liquid pressure permissible for the given device with the dimensions and weight thereof remaining unaffected.

A further important feature of the invention is to provide a device for building up high pulse liquid pressures, wherein a piston and a high-pressure chamber would feature such a constructional arrangement that would provide for maximum liquid pressure permissible for this type of device with the weight and dimensions thereof remaining unaffected.

Another object of the present invention is to increase the factor of utilization of energy derived from the piston acceleration.

These and other objects of the invention are attained in a device for building up high pulse liquid pressures, which device comprises at least one cylinder accommodating a stepped piston provided with an acceleration actuator; said piston having one step of smaller diameter disposed, during the piston stroke, within a high-pressure chamber communicating with a liquid supply source and fitted with an opening for liquid discharge. The piston step of smaller diameter has a rod with a free end thereof provided with a widening near it, and the high-pressure chamber has a constricted portion extending into a widening towards the opening for the liquid discharge, the constricted portion therewith being disposed so as to be overlapped by the widening of the rod at the initial stage of the piston stroke intended to lock the liquid within the high-pressure chamber in the space between the constricted portion thereof and the smaller-diameter step of the piston when high pressure of the particular liquid is built up. When the piston continues to move in the space between the rod and constricted portions, extending into widenings, a channel with annular cross section is formed, and said channel communicating the high-pressure chamber with the opening for the liquid discharge.

The constructional arrangement of the device makes it possible to prevent liquid from escaping from the high-pressure chamber during the process of high pressure build-up. Thus, the outflowing jet assumes the tubular shape, which, in turn, results in more powerful impact of the liquid on a solid rock, utilizing the same amount of energy derived from the piston acceleration as compared to the prior-art devices.

It is expedient that the aforementioned channel with annular cross section should have its cross-sectional area varied along the channel length in accordance with the following relationship:

$$(Sx/So) = \sqrt{1 - (x/a)},$$

where:

$x$ is the current coordinate of a point of the rod surface passing into a widening at the free end thereof, as the rod travels along the longitudinal axis of the high-pressure chamber, which equals zero at the moment of completing of the high-pressure chamber opening procedure;

$Sx$ is the value of the channel cross-sectional area corresponding to the current coordinate $x$;

$So$ is the value of the channel cross-sectional area corresponding to the current coordinate $x = 0$; and $a$ is the value constant for given device and equal to the distance of uniformly decelerating travel of the rod from $x = 0$ to $X$.

This makes it possible to maintain the liquid pressure within the high-pressure chamber at a value equal to the constant value over the entire length of the piston travel with respect to the high-pressure chamber, which substantially increases the energy of the discharge liquid without increasing the volume of the high-pressure chamber.

A device for building up high pulse liquid pressures, provided in accordance with the present invention, provides for substantially higher force of the outflowing liquid jet, the device dimensions remaining the same, as well as for higher utilization factor of the energy derived from the piston acceleration, as compared to the prior-art device.

Moreover, when the device is in use, the consumption of energy per unit of the destructed rock is brought down. In other words, the efficiency of the device is considerably enhanced while its performance characteristics remain unaffected.

The higher effectiveness of destruction of rocks by liquid jets from the device, is attained due to a tubular shape imparted to the liquid jet, which, on the one hand, increases a number of collisions between the jet and various rock flaws, such as surface cracks, and, on the other hand, allows secondary jets to be formed from the rock surface runoff liquid falling off the contact periphery of the initial jet and rock towards the center of the jet. The fact that the tubular jet is made hollow, due to the taper-shaped outlet opening in the channel, permits the imparting of a velocity component to the liquid particles, this being directed towards the jet axis. Thus, the liquid jet density is increased and its spraying-off is much less.

The invention will now be explained in greater detail with reference to the embodiments thereof which are represented in the accompanying drawings, wherein.

Figure 1:
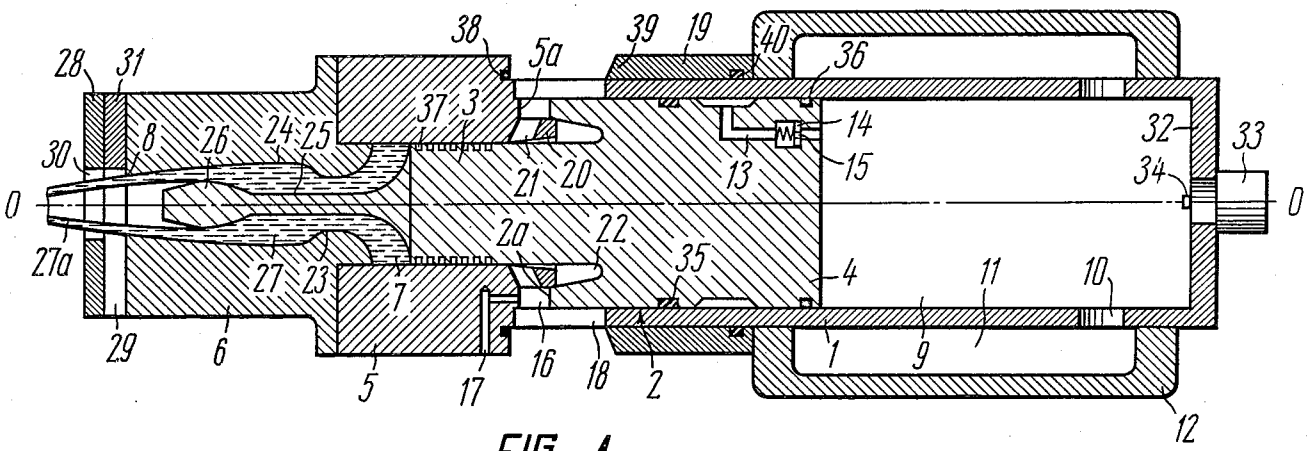
FIG. 1 is a schematic longitudinal sectional view of an embodiment of a device for building up high pulse liquid pressures, wherein the smallest cross-sectional area of annular channel *Sx* is adjusted by varying the diameter of a high-pressure chamber.
Figure 2:
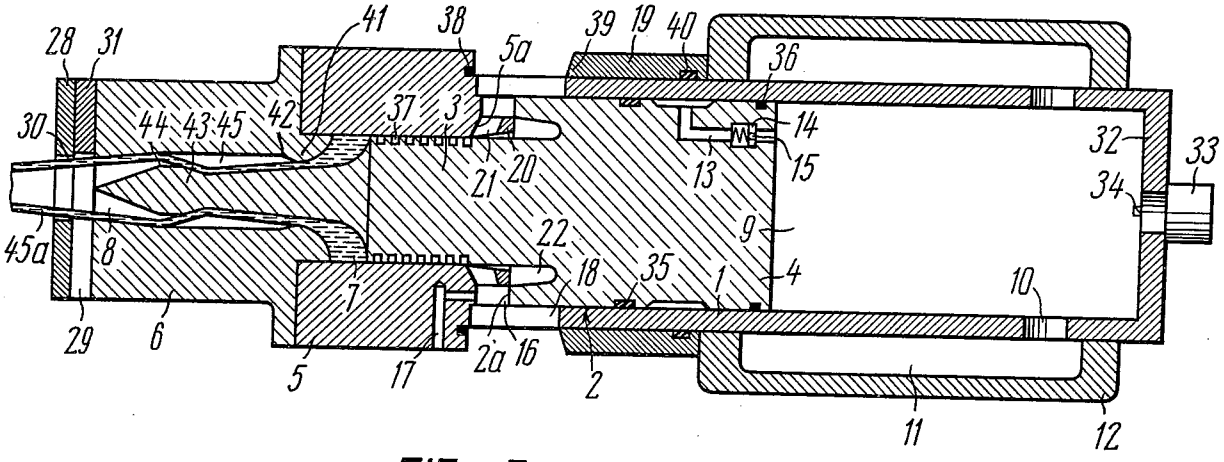
FIG. 2 shows an embodiment of FIG. 1, wherein the smallest cross-sectional area of annular channel *Sx* is adjusted by varying the piston rod diameter.
Figure 3:
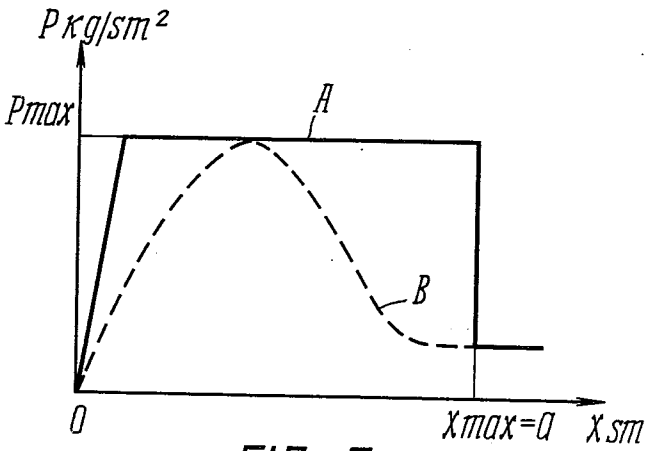
FIG. 3 graphically represents the liquid pressure in the high-pressure chamber versus the length of the piston stroke plotted down in the coordinate X.

Referring now to FIGS. 1–3, the principle and operation of the invention is disclosed.

A device for building up high pulse liquid pressures comprises a cylinder 1 (FIG. 1). The cylinder 1 houses a two-step piston 2 having a step 3 of smaller diameter and a step 4 of larger diameter. Contiguous to the cylinder 1 and fixedly attached thereto from the side of the smaller-diameter step 3 of the piston 2 is a sleeve 5 with a headpiece 6 rigidly fastened thereto. The axis of the headpiece 6 and that of sleeve 5 aligns with longitudinal axis 0—0 of the cylinder 1.

The smaller-diameter step 3 of the piston 2 together with the inside surfaces of the sleeve 5 and the headpiece 6 define a high-pressure chamber 7.

Fitted in the headpiece 6 along axis 0—0 is an outlet opening 8 connecting the chamber 7 with the atmosphere.

From the side of the larger-diameter step 4 of the piston 2, the cylinder 1 houses a low-pressure chamber 9 which is brought into communication through an opening 10, disposed in the wall of the cylinder 1, with a receiver 11. The receiver 11 is formed by a cylindrical cowling 12 placed over the outside surface of the cylinder 1 and it is rigidly coupled therewith. The low-pressure chamber 9 and the receiver 11 are filled with compressed gas intended for accumulation of energy during the forced travel of the piston 2 in the direction of the low-pressure chamber 9, and at the time of acceleration of the piston 2 in the direction of the high-pressure chamber 7.

The step 4 of the piston 2 is provided with an angular channel 13 connecting the low-pressure chamber 9 with the receiver 11, which takes place when the piston 2 is approaching the extreme right-hand position, as best shown in FIGS. 1 and 2 of the drawing. The channel 13 is fitted with a non-return valve 14 which serves to direct a flow of compressed gas in the direction from the chamber 9 toward the receiver 11. The valve 14 is provided with a jet head 15 which allows but a small quantity of gas to pass from the receiver 11 into the chamber 9 when the piston 2 starts moving to the left from its extreme right-hand position. The piston 2 is thus slightly retarded prior to acceleration in the reverse direction which is regulated by the cross-sectional area of the jet head 15. The high-pressure chamber 7 is in communication with a liquid supply source (not shown) when the step 3 of the piston 2 passes out of the high-pressure chamber 7. The chamber 7 is brought into communication with a liquid supply source through a space 16 and a channel 17 disposed in the body of the sleeve 5. The space 16 is defined by the rear end of the sleeve 5 together with the inside surface of the cylinder 1 and the front end of the step 4 of the piston 2. With the piston 2 travelling in the right-hand direction, as viewed in FIGS. 1 and 2 of the drawing, the space 16 is expanded as the liquid proceeds to accumulate therein.

In close proximity with the sleeve 5, within the side wall of the cylinder 1 are ports 18 spaced equidistantly along the periphery of a circumference. It is preferable that the total cross section of the ports 18 be equal to or even slightly larger than the cross-sectional area of the step 4 of the piston 2, which results in the lower hydraulic impedance arising at the time of the liquid discharge from the space 16 through the ports 18 into the atmosphere.

The external surface of the cylinder 1 is fitted over with a cylindrical sleeve 19 mounted so as to be adapted for reciprocating motion. The cylindrical sleeve 19 serves to overlap the ports 18 as the piston 2 is forced to travel in the direction of the low-pressure chamber 9, and to open the ports 18 to make possible the acceleration of the piston 2 by gas, as said piston moves towards the sleeve 5.

There is provided conventional means (not shown) for driving the sleeve 19 along the external surface of the cylinder 1, said means being of any type appropriate for the purpose.

Facing the piston 2 on the right-hand face of the sleeve 5 (as viewed in the drawing) is an annular lug 20 with a diameter of the internal surface thereof increasing towards its end. This facilitates the entry of the step 3 of the piston 2 into the high-pressure chamber 7. The lug 20 has openings 21 providing for free escape of liquid along the lug 20 from the chamber 7 into the space 16 and its subsequent discharge through the ports 18, which takes place at the time when the step 3 of the piston 2 is moving in the left-hand direction, as viewed in FIGS. 1 and 2 of the drawing.

The internal surface of the headpiece 6 has in its region adjacent the sleeve 5 constricted portions 23 extending into widenings 24 gradually narrowing towards the outlet opening 8. Rigidly secured to the step 3 of the piston 2 is a rod 25 with a free end 26 thereof passing along the constricted portion 23 and the widening 24 area of the headpiece 6 as the piston 2 travels in the left-hand direction.

The free end 26 of the rod 25, having in the herein disclosed embodiment of the invention constant cross-section along its length, has a widening which is also at 26. The diameter of the widening 26 is approximately equal to that of the constricted portion 23. Due to this the constricted portion 23 of the headpiece 6 is overlapped by the widening 26 of the rod 25 as the piston 2 moves to lock the liquid within the high-pressure chamber 7 in the space between the constricted portion 23 and the step 3 of the piston 2, when building up high pressure of said liquid.

The widening 26 of the rod 25 is disposed at such a distance from the step 3 of the piston 2 as to provide for simultaneous overlapping of the openings 21 of the lug 20 and the constricted portion 23 of the headpiece 6 with the piston 2 moving therealong.

As the piston 2 continues to move to the left, there is formed a channel 27 in the space between the rod 25 and the constricted portions 23, and the widening 24 of the high-pressure chamber 7, and said channel having an annular cross section and connecting the high-pressure chamber 7 with the outlet opening 8 for the discharge of liquid in the form of the tubular jet 27*a*. The channel 27 narrows towards the opening 8.

The internal surface of the widening 24 and the widening 26 are projected so that the cross-sectional area of the channel 26 varies along the length thereof according to the following relationship:

$$(Sx/So) = \sqrt{1 - (x/a)},$$

where:

$x$ is the current coordinate of a point of the rod 25 passing into the widening 26 at the free end thereof along the longitudinal axis 0—0 of the high-pressure chamber 7, which equals zero at the moment of completing of the high-pressure chamber 7 opening process;

$Sx$ is the value of the cross-sectional area of the channel 27 with an annular cross section, corresponding to the current coordinate $x$ measured along axis 0—0;

$So$ is the value of the cross-sectional area of the channel 27 with an annular cross-section corresponding to the current coordinate $X = 0$ measured along axis 0—0; and $a$ is the value constant for given device and equal to the distance of uniformly decelerating motion performed by the rod 26 together with the piston 2 from $X = 0$ to $X_{max}$.

In the present embodiment of the invention, the rod 25 has a constant diameter within the distance between the widening 26 and the step 3 of the piston 2. Between the mentioned diameter of the rod 25 and the widening 26, there is provided a smoothly shaped transition portion. The value of this diameter is selected such that the cross-sectional area of the annular channel 27 between the constriction portion 23 and the rod 25 would be several times the area *So*.

The selection of the rod 25 diameter in the manner described above results in lower hydraulic impedance of the channel 27 (having annular cross-section), as well as in greater effect of value *Sx* on the relationship between pressure in the high-pressure chamber 7 and time.

Secured to the face of the headpiece 6 in the proximity of the opening 8 is a plate 28 with a groove 29 therein. This plate 28 is disposed perpendicular to axis 0—0 of the cylinder 1, and is provided with an opening 30 disposed along axis 0—0 of the apparatus. Arranged in the groove 29 is a valve spool 31 adapted for reciprocating motion. The valve spool 31 is intended for overlapping the opening 8 as the piston 2 is forced to travel in the direction of the low-pressure chamber 9, and for exposing the opening 8 prior to acceleration of the piston 2 in the direction of the high-pressure chamber 7. There is provided a means (not shown) for driving the valve spool 31 in the groove 29 to be in step with sliding of the sleeve 19 along the side surface of the cylinder 1, said means being of any well-known design appropriate for the purpose.

Rigidly fixed to a bottom 32 of the cylinder 1 is a command sensor 33 having a control pin 34. The sensor 33, is suitably of any design appropriate for the purpose, as it is intended for sending a command to a means (not shown) for driving the sleeve 19 in the direction of the ports 18 to be opened thereby, as well as for driving the valve spool 31 to expose the opening 8 under the impact of the piston 2 as the latter travels in the right-hand direction, as viewed in the drawing, towards the control pin 34.

The piston 2 is provided with an elastic packing 35, to ensure compressed gas-tightness, and with a metallic packing 36 which serves to eliminate leakage of compressed gas between the low-pressure chamber 9 and the receiver 11 when the piston 2 is in its extreme right-hand position, according to the drawing.

Disposed on the side surface of the smaller-diameter step 3 of the piston 2 are circular grooves 37 in the form of labyrinth packing provided for preventing high-pressure liquid from leaking out of the chamber 7 towards the space 22.

Pressed into the face of the sleeve 5 from the side of the cylinder 1 is a sealing ring 38 which seals against an annular lug 39 at the time when the ports 18 are closed by the sleeve 19.

The sleeve 19 is in turn sealed, with respect to the external surface of the cylinder 1, with an elastic packing 40.

FIG. 2 illustrates another embodiment of the invention for building up high pulse liquid pressures, wherein constricted portions 41 passing into widenings 42 are disposed on the interval surface of the headpiece 6 in the proximity of the sleeve 5.

Rigidly fastened to the step 3 of the piston 2 is a rod 43, having a cross-section which varies along its length. A free end 44 of the rod 43 passes the constricted portions 41 and the widenings 42 of the headpiece 6. The free end 44 of the rod 43 has a widening also at 44. The diameter of the widening 44 is approximately equal to that of the constricted portion 41. Due to this fact the constricted portion 41 of the headpiece 6 is overlapped by the widening 44 of the rod 43 as the piston 2 moves to lock the liquid within the high-pressure chamber 7 in the space between the constricted portion 41 and the step 3 of the piston 2, when building up high pressure of the liquid. The widening 44 on the rod 43 is disposed at such a distance from the step 3 of the piston 2 as to provide for simultaneous overlapping of the openings 21 of the lug 20 and the constricted portion 41 of the headpiece 6, with the piston 2 moving at the time.

As the piston 2 continuous to travel to the left, as viewed in the drawings, there is formed a channel 45 in the space between the rod 43 and the constricted portion 41, and the widening 42 of the high-pressure chamber 7, and said channel has an annular-section and connects the high-pressure chamber 7 with the outlet opening 8 for the discharge of liquid in the form of the tubular jet 45*a*. The external profile of the rod 43 and the constricted portion 41 are projected so that the cross-sectional area of the channel 45 varies along the length thereof to obey to the following relationship:

$$(Sx/So) = \sqrt{1\ 31\ (x/a)}$$

where:

$x$ is the current coordinate of a point of the rod 43*b* passing into the widening at the free end thereof along the longitudinal axis 0—0 of the high-pressure chamber 7, which equals zero at the moment of completing the high-pressure chamber 7 opening process;

$Sx$ is the value of the cross-sectional area of the channel 45 with an annular cross-section, corresponding to the current coordinate $x$ measured along axis 0—0;

$So$ is the value of the cross-sectional area of the channel 45 with an annular cross-section, corresponding to coordinate $x=0$ measured along axis 0—0; and $a$ is the value constant for given device and equal to the distance of uniformly decelerating motion performed by the rod 43 together with the piston 2 from $X = 0$ to $X_{max}$.

The diameter of the widening 42 within the distance between the constricted portion 41 and the outlet opening 8 is constant on the way of relative motion of the widening 44 of the rod 43, and further on closer to the opening 8 is narrow and said diameter is similar to that in the previously discussed embodiment. The constricted portion 41 smoothly passes into the widening 42. The value of diameter of the widening 42 is selected such that the cross-sectional area of the annular channel 45 between the widening 44 of the rod 43 and the widening 42 of the high-pressure chamber 7 would be several times the area *So*. The selection of diameter of the widening 42 in the manner described above results in greater effect of valve *Sx* on the relationship between pressure in the chamber 7 and time.

This invention may be variously otherwise embodied, for example, the proposed device may be based on the use of any other actuating means for the piston acceleration, such as detonation of an explosive or by virtue of combustible gaseous mixture in the chamber 9, or else by employing magnetic forces for the same purpose.

The apparatus shown in FIG. 1 operates as follows.

When in the initial position, the piston 2 is pressed by the gas to the face 5*a* of the sleeve 5, with the ports 18 and openings 8 being opened therewith. At this time the face 2*a* of the piston 2 closes the outlet opening of the channel 17 communicating with the space 16. This closure is not intended to be hermetically sealed, since suitable drain passages (not shown) are provided. When a liquid supply source (not shown) is switched on, the liquid is pumped into the channel 17.

Higher pressure built up in the chamber 17 is used by the control system (not shown) to actuate a driving means (not shown) which cause the sleeve 19 to slide over towards the packing 38, thereby overlapping the ports 18, and causing the slide valve 31 to slide towards the over-lapping of the opening 8. After the ports 18 and the opening 8 have been closed, the liquid pressure is built up in the space 16 until it reaches the value indicative of sufficient amount of energy, accumulated in the liquid, capable of forcing the piston to travel towards the chamber 9 filled with gas. The gas, when compressed, accumulates energy. There is partial outflow of gas from the chamber 9 into the receiver 11 through the opening 10. As the piston 2 travels in the right-hand direction, as viewed in the drawing, at the time when the face of the piston 3 passes the opening 21, the liquid, delivered from the channel 17 through the space 16 and the opening 21, fills up the chamber 7. As the piston 2 travels in the right-hand direction, as viewed in the drawing, there comes a moment when the piston 2 overlaps the opening 10, thus cutting off a part of the chamber 9 between the piston 2 and the bottom 32. Henceforth, the gas is by-passing from the chamber 9 into the receiver 11 via the non-return valve 14.

When in its right-hand extreme position, according to the drawing, the piston 2 actuates the control pin 34 of the command sensor 33. As a result of this, the sensor 33 is operated to send a command to a driving means (not shown) causing the bushing 19 and the sliding valve 31 to move with a purpose of exposing the ports 18 and the openings 8. Just as the ports 18 start opening, the liquid pressure in the space 16 starts dropping, which is due to expansion of said space. This process continues until the ports 18 are fully opened. From this moment onwards, the piston 2 is solely under the effect of the compressed gas filling the space between the bottom 32 of the cylinder 1 and the face of the piston 2. But the travelling speed of the piston 2, when under the action of compressed gas, is limited, because of the sealing ring 38 and the jet head 15 which serve to keep down the flow rate of gas passing into the space between the bottom 32 and the face of the piston 2. In this regard, the openings 10 are overlapped by the piston 2.

The time required for the piston 2 to travel at a low speed from the bottom 32 up to the moment when the piston 2 starts exposing the openings 10 is the time lag of the piston prior to its acceleration. This time is adjusted by the passage area of the jet head 15 and selected so as to be sufficient for complete opening of the ports 18 by the sleeve 19, and for complete exposure of the opening 8 by the valve spool 31.

As the openings 10 start to open, the flow rate of gas passing from the receiver 11 into the chamber 9 rapidly increases, which is the starting point of the further intensifying acceleration of the piston in the direction of the high-pressure chamber 7. In addition, the liquid is discharged from the space 16 into the atmosphere through the ports 18. When moving, the piston 2 overlaps with its step 3 the openings 21 in the lug 20, while the widening 26 of the rod 25 overlaps the constricted portion 23 of the headpiece 6, thereby locking the liquid within the chamber 7.

The continued travelling of the piston 2 results in the pressure surge of the liquid locked within the high-pressure chamber 7 in the space between the constricted portion 23 and the step 3 of the piston 2.

As the piston 2 passes further on in the interspace between the rod 25 and the constricted portion 23 subsequently extending into the widening 24 of the high-pressure chamber 7, there is formed channel 27 of annular cross-section, and said channel communicating the high-pressure chamber 7 with the opening 8 for the liquid discharge.

The annular cross-section of the channel 27 is at its minimum between the widening 26 of the rod 25 and the widening 24 of the high-pressure chamber 7 along the length of the channel 27, forming the tubular hollow jet 27*a* projected towards the opening 8.

Here, the law of pressure change within the high-pressure chamber 7 depends upon the shape of the internal surface of the widening 24. The shaping of the internal surface of the widening 24 according to the mathematical relationship given hereinabove, will result in the liquid discharge at almost constant pressure in the high-pressure chamber 7, which in fact provides for almost constant speed of said liquid discharge.

In the first herein described embodiment of the invention shown in FIG. 1, the difference between the area of the opening of the headpiece 6 at the place of the constriction 23 and that of the current cross-section of the rod 25, passing through said constriction, is always well above the difference in the area of the opening of the headpiece 6 and the maximum cross-sectional area of the widening 26 of the rod 25, at any cross-section along the length of the channel 27. That is why the liquid pressure in the channel 27 approximates its maximum, which results in that the liquid discharge is effected under a pressure approximating its maximum value.

In the embodiment of the invention shown in FIG. 2, the difference in the area of the headpiece 6 at the place of the constriction 41 and the cross-sectional area of the rod 43 is always less than the difference in the cross-sectional area of the headpiece 6 and the maximum cross-sectional area of the widening 44 at any section along the length of the channel 45. Therefore, the liquid pressure in the channel 45 is lower than that in the chamber 7. Thus, the outflow of liquid in the form of the hollow jet 45*a* commences in the section of maximum constriction 41 of the headpiece 6. As a result of this, the channel 45 is not filled with liquid to its fullest. At the left-hand side of the constriction 41, according to FIG. 2, the hollow jet 45*a* moves in the channel 45 along the surface of the rod 43, and said jet passing over at the place of widening 44 of the rod 43 on to the wall of the headpiece 6 and keeps moving therealong until it flows out of the apparatus.

It is apparent from the foregoing description of the present apparatus that higher pressure built up in the chamber 7 is not accompanied by the fluid discharge, which is then effected under almost constant pressure. This makes it possible to substantially enhance the efficiency of utilization of energy derived from the piston acceleration, since there is no need in using energy for the liquid discharge in the form of low-speed jets. The permissible energy of the discharged liquid is likewise increased, since the outflow of liquid is effected at almost constant speed throughout the entire length of travel of the piston 2 relative to the high-pressure chamber 7.

FIG. 3 graphically represents the relations between the liquid pressure in the high-pressure chamber 7 (Y-axis) and the distance covered by the piston 2 (axis of X). Curve A corresponds to the change of pressure in the device according to the invention. Curve B corresponds to the change of pressure in the prior-art device.

As may be seen, curve B corresponds to the maximum value of energy which is proportional to the value of integral $Sp \cdot d_x$ at a preset maximum value of pressure $p$.

From curves A and B it will be obvious that the realization of the present invention makes it possible to apply any other law of change of the function $p = f(x)$ by way of changing the shape of the internal surface of the widening 24 of the high-pressure chamber 7.

As the piston 2 continues to move, value $x$ will approximate value "$a$", $Sx$ approaches 0, the speed of the piston 2 also approaches 0.

However, since it is next to impossible for value $Sx$ to be equal to zero, due to the clearance provided in the device during its construction, the piston 2 is ultimately paced at a low uniform speed, expelling the liquid out of the high-pressure chamber 7 through a circular clearance defined between the widening 26 of the stock 25 and the widening 24 of the chamber 7.

At the end of the stroke, the face 2*a* of the piston 2 rests upon the face 5*a* of the ring 5, then overlaps the outlet opening of the space 16 adjacent the channel 17, and the process thereafter is recycled automatically.

The apparatus shown in FIG. 2 operates in similar manner with the only difference residing in that the law of change of pressure in the high-pressure chamber 7 is preset by shaping of the rod 43 in correspondence with the same mathematical relationship.

The both embodiments of the invention referred to in FIG. 1 and in FIG. 2, the widening 24 (FIG. 1) and the widening 42 (FIG. 2), are narrowed in the region adjacent the outlet opening 8, which permits imparting a velocity component to the hollow jets 27*a* and 45*a*, this being directed towards the jet axis. Thus, the jet density is increased and its spraying is much less.

Prototype model of the herein proposed device for building up high pulse liquid pressures was put to arduous tests, thus attesting to the high efficiency of the device.

What is claimed is:

1. A device for building up high pulse liquid pressures, comprising: at least one cylinder; a liquid supply source; a high-pressure chamber being disposed in said cylinder and communicating with said liquid supply source; an opening for liquid discharge, said opening being disposed in communication with high-pressure chamber; a constricted portion of said high-pressure chamber; a portion of said high pressure chamber widening towards said opening for the liquid discharge; a stepped piston being accommodated in said cylinder; a step with a smaller diameter in said stepped piston, said step being disposed within said high-pressure chamber with said stepped piston travelling to build up high pulse pressure; a rod attached to said step of smaller diameter in said stepped piston, said rod having a free end; a widening portion of said rod extending near the free end thereof; said widening portion overlapping said constricted portion of said high-pressure chamber at the beginning of the working stroke of said piston to lock the liquid within said high-pressure chamber in the space between said constricted portion and said smaller-diameter step of said stepped piston when high pressure of said liquid is being built up; a channel with annular cross-section, communicating said high-pressure chamber with said opening for the liquid discharge, said channel being formed during continuing travel of said stepped piston in the space between said rod and said constricted portion, and passing into said widening portion of said high-pressure chamber towards said opening for the liquid discharge disposed in said high-pressure chamber; and an actuator for acceleration of said stepped piston.

2. A device as claimed in claim 1, wherein said channel with annular cross-section having cross-sectional area thereof varied along the channel length in accordance with the following relationship:

$$(Sx/So) = \sqrt{1 - (x/a)},$$

where:

$x$ is the current coordinate of the widened portion of the rod free end as the rod travels along the longitudinal axis of the high-pressure chamber, which equals zero at the moment of completing the high-pressure chamber opening process;

$Sx$ is the value of the channel cross-sectional area corresponding to the current coordinate X;

$So$ is the value of the channel cross-sectional area corresponding to coordinate $X = 0$; and $a$ is the value constant for given apparatus and equal to the distance of uniformly decelerating motion of the rod from $X = 0$ to $X_{max}$.

* * * * *